United States Patent [19]

Kirii

[11] 4,325,173

[45] Apr. 20, 1982

[54] METHOD AND APPARATUS FOR FINISHING A PAIR OF ELONGATE SLIDE FASTENER STRINGERS

[75] Inventor: Kazuo Kirii, Kurobe, Japan

[73] Assignee: Yoshida Kogyo K.K., Tokyo, Japan

[21] Appl. No.: 94,501

[22] Filed: Nov. 15, 1979

[30] Foreign Application Priority Data

Nov. 16, 1978 [JP] Japan ..... 53-141606

[51] Int. Cl.[3] ..... B29D 5/00; A41H 37/06

[52] U.S. Cl. ..... 29/408; 29/767; 219/243

[58] Field of Search ..... 29/33.2, 408, 410, 766, 29/767; 219/243, 246, 247; 72/465; 425/814

[56] References Cited

U.S. PATENT DOCUMENTS 3,340,594 9/1967 Fröhlich et al. ..... 29/408
3,488,239 1/1970 Heimberger ..... 29/408 X
3,570,104 3/1971 Jensen ..... 29/766 X
3,705,446 12/1972 Gustavsson ..... 29/766 X
3,872,571 3/1975 Douri ..... 29/767 X

*Primary Examiner*—Carl E. Hall
*Assistant Examiner*—C. J. Arbes
*Attorney, Agent, or Firm*—Robert E. Burns; Emmanuel J. Lobato; Bruce L. Adams

[57] ABSTRACT

A pair of interengaged slide fastener stringers of elongate length are longitudinally advanced in an intermittent manner over a clincher die and a heater plate. An end stop is vertically driven by a punch above the clincher die and is attached to the stringers at a terminal end of one of the longitudinally spaced chains of coupling elements. A portion of the stringer tapes is heated and fused adjacent to the terminal end of the coupling element chain substantially simultaneously with the end stop attaching operation. Such fusing operation is carried out by a presser vertically movable for pressing the stringer tapes against the heater plate.

9 Claims, 5 Drawing Figures

METHOD AND APPARATUS FOR FINISHING A PAIR OF ELONGATE SLIDE FASTENER STRINGERS

BACKGROUND OF THE INVENTION

1. Field of the Invention

The present invention relates to a method of and an apparatus for finishing or treating a pair of elongate slide fastener stringers before being cut off into individual slide fastener lengths.

2. Prior Art

There have heretofore been known various methods of treating or finishing slide fastener stringers or stringer tapes so that they will be free of fraying or ravelling at cut edges after they are cut off into individual slide fastener lengths. For example, it has been customary to apply films of synthetic resin to the stringer tapes or to impregrate the tapes with a solution of synthetic resin where they are to be cut off, before severance. Such procedural step must be carried out independently of the other process steps, and hence renders the overall process more complicated, time-consuming, and less productive of finished fastener products per unit time. Another conventional practice for producing fraying-free tape edges is to cut off the stringer tapes with a heated or ultrasonically vibrated blade for fusing cut edges at the same time as the tapes are severed. This procedure is disadvantageous in that the blade must be held in its actuated position until the cut edges of the tapes become completely fused and made fraying-free. It is also time-consuming and thus results in a reduced rate of productivity.

SUMMARY OF THE INVENTION

According to the present invention, a pair of slide fastener stringers including longitudinally spaced chains of interengaged rows of coupling elements mounted on a pair of respective stringer tapes are fused where they are to be cut later, substantially at the same time as end stops are attached one at a time to the slide fastener stringers at terminal ends of the chains. The fusion of the tapes is effected in response to the end stop attachment, and is made only at surface portions thereof. An apparatus for carrying out such finishing process includes means responsive in timed relation to the actuation of an end stop attaching means for fusing the stringer tapes for a suitable interval in a transverse direction thereof.

It is an object of the present invention to provide a method of finishing slide fastener stringers for tape-fraying-free treatment substantially simultaneous with end stop attachment.

Another object of the present invention is to provide an apparatus for carrying out such a method.

The above and other objects, features and advantages of the present invention will become apparent from the following description of the invention in conjunction with the accompanying drawings. BRIEF DESCRIPTION OF THE DRAWINGS FIG. 1 is a vertical cross-sectional view of an apparatus constructed in accordance with the present invention;

DETAILED DESCRIPTION OF THE PREFERRED EMBODIMENT

Figure 1:
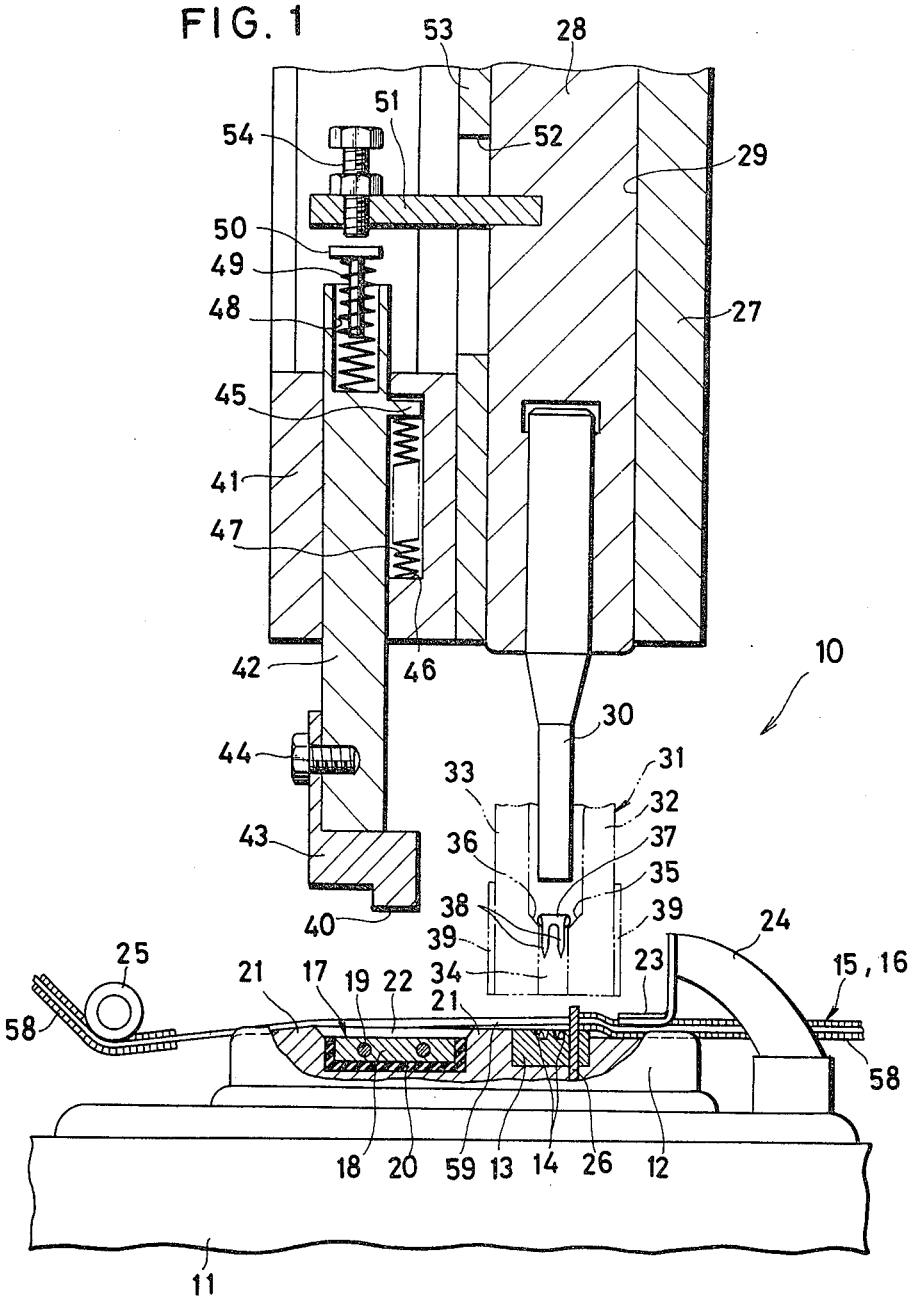

As shown in FIG. 1, an apparatus 10 according to the present invention comprises a lower frame 11 supporting thereon a die base 12 which carries a clincher die 13 including a pair of clinching die recesses 14 opening upwardly. A pair of interengaged slide fastener stringers 15,16 (FIGS. 1 and 2) intermittently moves in a longitudinal direction thereof from the right to the left in FIG. 1, over the clincher die 13.

A suitable heater such as electric heater 17 is also mounted on the die base 12 and is located adjacent to and downstream of the clincher die 13 with respect to the direction of movement of the slide fastener stringers 15,16. The heater 17 includes a heater plate 18 made of a thermally conductive material, a heater element 19 such as an electrical heating wire connected to a power supply (not shown) and embedded in the heater plate 18, and a thermal insulator 20 interposed between the heater plate 18 and the die base 12 for thermal insulation therebetween. A peripheral land 21 projects upwardly surrounding the heater 17 for keeping the slide fastener stringers 15,16 normally spaced by a spacing 22 from the heater plate 18. Since the slide fastener stringers 15,16 are normally out of contact with the heater plate 18, they are prevented from being subjected to intensive heat under conditions in which they remain over the heater plate 18 during accidental or intentional stoppage of the apparatus 10.

A chain guide 23 having a downwardly opening groove is supported by a chain guide mount 24 fixed to the frame 11. The slide fastener stringers 15,16, the details of which will be described later, are guided by the chain guide 23 for travel over the die 13 and the heater 17 and are directed by a guide roll 25 toward a further processing station where the slide fastener stringers 15,16 will typically be cut off into individual slide fastener lengths.

A vertically reciprocable stop 26 retractably projects upwardly from the clincher die 13 to stop the slide fastener stringers 15,16 in position on the die base 12 for end stop attaching and stringer tape fusing operation described later.

An upper frame 27 is disposed above the lower frame 11 and supports a vertically driven punch holder 28 movable through a guide slot 29 in the frame 27. The punch holder 28 carries on its lower end a punch 30 held in vertical registry with the clincher die recesses 14.

An end stop holder 31 shown in two-dot-dash lines are positioned just upwardly of the clincher die 13 and includes a pair of holder arms 32,33 pivotally or otherwise movably supported relatively to the lower frame 11 so that the holder arms 32,33 are retractable away from each other. An end stop passage 34 is defined jointly by opposed faces of the holder arms 32,33, the opposed faces extending downwardly from a pair of inclined shoulders 35,36 on the respective holder arms 32,33, which support therebetween one of bottom end stops 37 at a time that are supplied laterally in sequence from a suitable end stop supply chute (not shown), the bottom end stop 37 including clinching legs 38 that hang down in the end stop passage 34. The holder arms 32,33 are normally biased toward each other by means of a leaf spring 39.

A guide frame 41 is fixed to the upper frame 27 and supports therein a vertically reciprocable presser holder 42 carrying on its lower end a presser 43 secured in position by a screw 44. The presser 43 has a presser surface 40 facing downwardly in vertical registry with the heater plate 18, the presser surface 40 being located downwardly of the distal end of the punch 30 at all times during operation of the apparatus 10. The presser holder 42 includes a transverse arm 45 projecting into a vertical guide recess 46, there being a return spring 47 disposed in the guide recess 46 for normally urging the transverse arm 45 and hence the presser holder 42 upwardly away from the heater 17.

The presser holder 42 has in an upper end portion thereof a hole 48 retaining therein a compression spring 49 which has a stronger restoring force than the return spring 47 does. The compression spring 49 carries thereon a follower 50 vertically movable toward or away from the presser holder 42 against or under the resilience of the compression spring 49. A drive lever 51 extends laterally from the punch holder 28 through a recess 52 in a wall 53 of the upper frame 27. An adjustment screw 54 is threaded and extends through the drive lever 51 for driving engagement with the follower 50.

Figure 2:
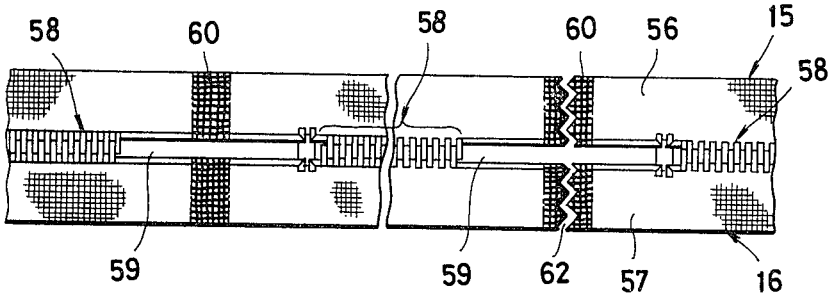
FIGS. 2 and 3 are fragmentary plan views of two pairs of coupled slide fastener stringers, both subjected to tape-fraying-free treatment according to the invention.

As illustrated in FIG. 2, the pair of slide fastener stringers 15,16 are composed of a pair of respective stringer tapes 56,57 including synthetic resin fibers, a plurality of longitudinally spaced chains 58 of interengaged rows of coupling elements, there being coupling-element-free spaces or gaps 59 between adjacent coupling element chains 58.

The apparatus 10 of the present invention operates as follows: In FIG. 1, the slide fastener stringers 15,16 are advanced longitudinally over the die base 12 and, when one of the coupling-element-free gaps 59 is moved onto the die base 12, the stop 26 projects upwardly into the gap 59. The advancing movement of the slide fastener stringers 15,16 comes to a halt when the stop 26 is engaged by a terminal end of one of the chains 58 which is next to said gap 59. At this time, a portion of the stringer tapes 56,57 which is at the gap 59 adjacent to the terminal end of the chain 58 is disposed over the heater plate 18. Then, the punch holder 28 is actuated to move downwardly, enabling the punch 30 to push the bottom end stop 37 downwardly forcing the holder arms 32,33 apart until the clinching legs 38 of the bottom end stop 37 pierce the stringer tapes 56,57 and are clinched thereon by the die recesses 14 at the terminal end of the coupling-element-chain 58. The structure and operation of such end stop attaching device is well known in the art. Other types of end stop attaching device such as an end stop molding device may be used instead of the illustrated device.

Shortly after the punch holder 28 has started descending, the lower end of the adjustment screw 54 engages the follower 50 and the presser holder 42 is moved downwardly with the spring 47 being compressed by the downward movement of the punch holder 28. On the continued downward movement of the punch holder 28, the presser surface 40 comes into contact with said portion of the stringer tapes 56,57 over the heater plate 18 and presses that tape portion downwardly against the heated plate 18 just before the punch 30 applies the bottom end stop 37 to the stringers 15,16, because the presser surface 40 is downward of the distal end of the punch 30. While the stringer tapes 56,57 are being held in contact with the heated plate 18, the synthetic resin fibers in the tapes 56,57 are fused at an area 60 (FIG. 2), the shape of which corresponds to that of the presser surface 40. The punch holder 28 still moves downwardly to cause the adjustment screw 54 to push the follower 50 toward the presser holder 42 that is then held down inmovably with the spring 49 in compression, before the punch 30 is in its fully lowered position in which it applies the bottom end stop 37 to the stringers 15,16.

After the attachment of the bottom end stop 37 to the stringers 15,16, the punch holder 28 is retracted upwardly as the adjustment screw 54 is moved upwardly at the same time and rate as the punch holder 28. Since the spring 49 has a larger restoring force than the spring 47, the spring 49 is first allowed to start to be restored to its uncompressed state, during which the presser holder 42 is maintained in its lowered position. Then, as the punch holder 28 continues to ascend, the presser holder 42 initiates its upward movement under the resilience of the return spring 47 when the force stored up in the spring 47 overcomes the compressive force of the spring 49. The stringer tapes 56,57 are now out of contact with the heated plate 18.

With such an arrangement, the stringer tapes 56,57 contact the heated plate 18 slightly earlier than the punch 30 applies the bottom end stop 37, and are lifted out of contact with the heated plate 18 slightly later than the punch 30 starts to be retracted. This mode of operation, that is, lost motion driving operation is particularly advantageous in that the stringer tapes 56,57 are fused effectively regardless of a relatively short period of time (normally 0.5 second) required for the completion of one-cycle operation of the punch 30.

Figure 5:
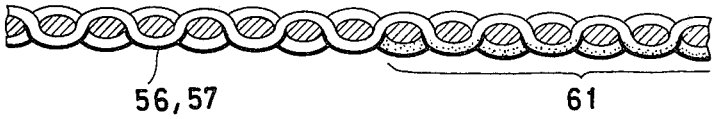
FIG. 5 is an enlarged cross-sectional view of the fused tape portion shown in FIG. 4.

As shown in FIG. 5, the stringer tape 56,57 has a fused zone 61 as a layer only on its one surface. However, such a one-sided fused surface layer is sufficient for rendering cut edges fraying-free because the fused synthetic resin fibers extend over the area 60 in which they unite together and which extends for a suitable transverse interval backward of the cut edge. An experiment has indicated that such a fused surface layer results from heating the stringer tapes 56,57 with the heater plate 18 for about 0.7 second.

The adjustment screw 54 adjusts the interval of time during which the stringer tapes 56,57 are kept in contact with the heated plate 18. For example, clockwise rotation of the screw 54 to cause its lower end to project a greater distance downwardly from the lever 51 will lengthen such interval of time.

The slide fastener stringers 15,16 thus finished are then severed transversely at 62 (FIG. 2) into individual slide fastener lengths. The cut edges are effectively prevented from fraying or ravelling by the fused surface layers 61. Subsequently, a slider and a top end stop are mounted on each individual slide fastener length.

Figure 3:
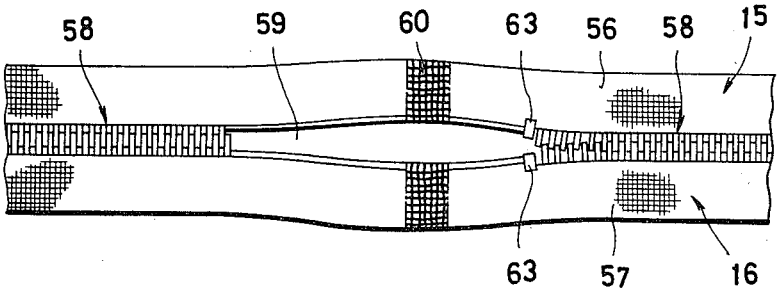
Figure 4:
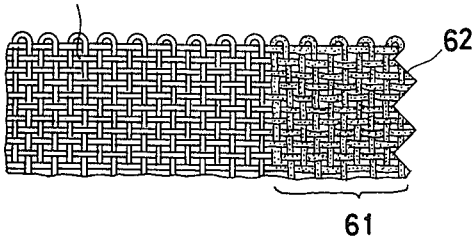
FIG. 4 is an enlarged, fragmentary plan view of the stringer tape shown in FIG. 2, illustrating a fused tape portion.

The punch 30, the end stop holder 31, and the clincher die 13 can be modified to attach a top end stop comprising a pair of stop members 63,63 (FIG. 3) to the slide fastener stringers 15,16. Such a modification is also well known in the art, and other structural details of the apparatus 10 remain the same as those mentioned with reference to FIG. 1.

Although a certain preferred embodiment of the present invention has been shown and described, it should be understood that many changes and modifications may be made without departing from the scope of the appended claims.

What is claimed is:

1. A method of finishing a pair of elongate slide fastener stringers including longitudinally spaced chains of interlocked rows of coupling elements mounted on a pair of respective stringer tapes, said method comprising the steps of:

(a) attaching end stops one at a time to the slide fastener stringers at terminal ends of the chains; and (b) fusing the stringer tapes in a transverse direction thereof adjacent to said terminal ends substantially at the same time as said attaching step (a), said fusing step (b) beginning slightly earlier and ending slightly later than said attaching step (a).

2. A method according to claim 1, wherein the stringer tapes are fused only at a portion of its one surface.

3. A method according to claim 1, wherein said fusing step (b) is effected for about 0.7 second.

4. A method according to claim 1, wherein the stringer tapes are fused for a transverse interval.

5. An apparatus for finishing a pair of elongate slide fastener stringers including longitudinally spaced chains of interlocked rows of coupling elements mounted on a pair of respective stringer tapes, said apparatus comprising:

(a) means for attaching end stops one at a time to the side fastener stringers at terminal ends of the chains;

(b) means disposed adjacent to said attaching means for fusing the stringer tapes transversely thereof adjacent to said terminal ends;

(c) means acting between said attaching means and said fusing means for actuating said fusing means in response to movement of said attaching means to begin fusing the stringer tapes slightly earlier and to terminate fusing the stringer tapes slightly later than the time end stops are attached to the fastener stringers by said attaching means.

6. An apparatus according to claim 5, said fusing means comprising a fixed member over which the stringer tapes are to be disposed, and a reciprocable member movable toward said fixed member to press the stringer tapes against the fixed member, by which said fixed and reciprocable members can coact to fuse the stringer tapes therebetween, said reciprocable member being movable in response to the actuation of said attaching means.

7. An apparatus according to claim 5, said fixed member comprising a heater, and said reciprocable member comprising a presser.

8. An apparatus according to claim 7, said attaching means comprising a fixed die over which the stringer tapes are to be disposed and a reciprocable punch movable toward said fixed die for applying the end stops to the slide fastener stringers on said fixed die, said acting means comprising a lateral lever fixed with respect to said reciprocable punch for driving engagement with said presser, and a spring on said presser for acting between said transverse lever and said presser to produce a lost motion therebetween during said driving engagement.

9. An apparatus according to claim 7, including means surrounding said heater for keeping the stringer tapes in spaced relation to said heater while said presser is away from the heater.

* * * * *